United States Patent [19]

Holmer

[11] Patent Number: 4,574,504

[45] Date of Patent: Mar. 11, 1986

[54] STORAGE CONTAINER

[76] Inventor: Lance F. Holmer, 38615 Gainsborough, Mt. Clemens, Mich. 48044

[21] Appl. No.: 616,195

[22] Filed: Jun. 1, 1984

[51] Int. Cl.[4] ..... G09F 3/18

[52] U.S. Cl. ..... 40/19; 40/10 R; 206/226; 206/225; 220/210

[58] Field of Search ..... 40/10 D, 905, 19, 10 A, 40/603, 10 R; 224/277; 24/67 R; 220/210; 206/580, 225, 226, 407, 415, 807

[56] References Cited

U.S. PATENT DOCUMENTS

| | | | |
|---|---|---|---|
| 707,511 | 8/1902 | Hoard | 24/67 R |
| 916,325 | 3/1909 | Kelly | 206/226 |
| 1,211,681 | 1/1917 | Currie | 40/19 |
| 1,841,266 | 1/1932 | Jones | 40/19 |
| 3,156,055 | 11/1964 | Hennessy, Jr. | 40/19 |
| 3,927,792 | 12/1975 | Andrade et al. | 220/210 |
| 4,334,373 | 6/1982 | Bryan | 40/10 D |
| 4,339,885 | 7/1982 | Brown | 40/19 |

*Primary Examiner*—Gene Mancene
*Assistant Examiner*—Cary E. Stone
*Attorney, Agent, or Firm*—Basile, Weintraub & Hanlon

[57] ABSTRACT

A container for storing and securing drawings. The container consists of an elongated tubular member that has a releasable cover at one end. The cover, which may be lockingly secured to the tubular member, contains a downwardly depending post upon which are secured one or more drawings that describe a specific piece of equipment to which the container is attached or located in close proximity. The drawings may be wrapped around the post and received within the tubular member which is enclosed by the cover.

5 Claims, 6 Drawing Figures

STORAGE CONTAINER

BACKGROUND OF THE INVENTION

I. Field of the Invention

The present invention relates to storage containers and, in particular, to a storage container for storing and securing drawings to ensure that the drawings will remain intact at a designated location when their use is required.

II. Description of the Prior Art

In many industrial installations requiring the use of complex machinery and electrical equipment, it is customary for the manufacturer of such equipment to provide the user with a set of drawings that will permit the user to service the equipment as the need may arise, without the necessity of the manufacturer's providing on-site service repairmen. In order to facilitate the on-site repair of such equipment by the user's personnel, it is necessary that, when there is an equipment failure, such personnel have immediate access to the drawings that describe the equipment in detail. It is common for a manufacturer to provide drawings to the equipment user who, in turn, stores such prints in an engineering department remote from the equipment. In many situations rapid repair of the equipment is essential. For example, the equipment may be employed in production assembly lines which are very expensive to close down in order to facilitate repair, or the equipment may involve public utilities or hospitals which have an urgent need to maintain such equipment in constant running condition. Thus, the locating of drawings at a location remote from the equipment is unacceptable.

One solution to this problem has been to provide prints of the equipment at the site of the equipment, and it is a common situation to find the drawings merely positioned in close proximity to the equipment in an unprotected manner such that many persons have access to the prints. It has become a problem in the repair of such equipment that when the appropriate personnel arrives to prepare failed equipment, the drawings that are required to facilitate the repair are missing or otherwise damaged and may not be usable. This results in a considerable delay in the repair of the equipment until a new set of drawings may be obtained.

It would therefore be desirable to provide a means for storing the aforementioned drawings in such a manner which ensures that the drawings will be available to the personnel who require them to repair equipment and which would limit access to such drawings to only those personnel who are authorized to make such repair.

SUMMARY OF THE INVENTION

The present invention, which will be described subsequently in greater detail, comprises a container for storing drawings in such a manner that the drawings may be viewed only by authorized personnel who have access to the drawings and which is designed in such a manner that the drawings will not be inadvertently removed from close proximity to the equipment for which they are intended to be utilized.

The invention is carried out by the provision of a tubular storage container that has one opening which may be enclosed by an end cover. The cover is provided with a post to which the drawings in question are secured and about which the drawings may be rolled. The post with the drawings attached thereto is insertable within the tubular member which, in turn, is enclosed by the cover. A suitable locking mechanism carried by the cover secures the cover to the tubular member to limit access thereto to only those authorized personnel who are provided with keys. The tubular member is attached in a permanent fashion to the equipment or adjacent the equipment which is described in the drawings that are disposed within the container.

It is therefore a primary object of the present invention to provide a new and improved container for storing drawings.

It is a further object of the present invention to provide such a storage container which may be mounted in close proximity to the equipment described in the drawings and in which access to such equipment is limited to authorized personnel.

Other objects, advantages and applications of the present invention will become apparent to those skilled in the art of storage containers when the accompanying description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
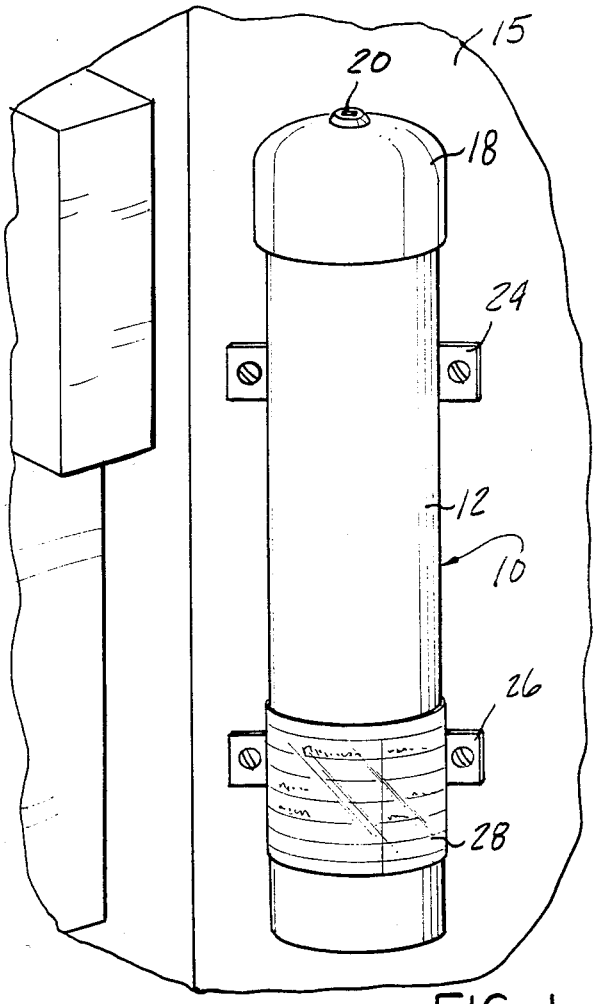
FIG. 1 is a plan front view of a drawing storage container mounted to a piece of equipment wherein the container is constructed in accordance with the principles of the present invention.
Figure 2:
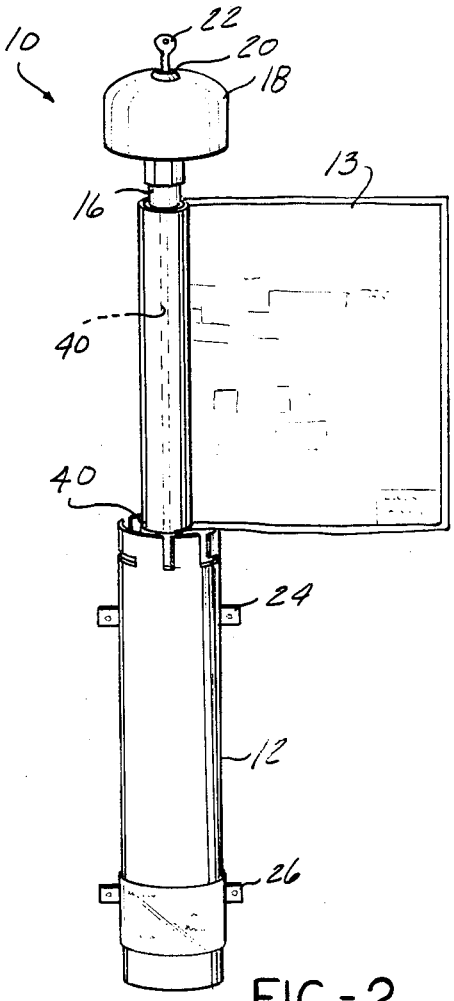
FIG. 2 is a view similar to FIG. 1 with the cover and enclosed drawings of the equipment removed.

Referring now to the drawing and, in particular, to FIGS. 1 and 2, there is illustrated one example of the present invention in the form of a storage container 10 adapted for storing one or more drawings 13. As can best be seen in FIGS. 1, 5 and 6, the container 10 comprises an elongated tubular member 12 which has a length of between 25 and 35 inches, depending upon the desired application, and a diameter of between 3 and 4 inches. Preferably, it is fabricated from a suitable plastic material, such as a PVC plastic, and has an appropriate wall thickness to ensure a suitable strength. The tubular member 12 is completely enclosed except for an opening 14 at the top end thereof which is adapted to receive a post 16 carried at the lower end of a cover 18 which, in turn, will enclose the opening 14 of the container 10. As will be described hereinafter, when the cover 18 is positioned on top of the tubular member 12 so as to enclose the same, as illustrated in FIG. 1 of the drawings 13, a lock 20 disposed at the top of the cover 18 may be secured by a key 22 (FIG. 2) so as to lockingly secure the cover 18 to the tubular member 12. By limiting distribution of the key 22 to authorized personnel, only those personnel will have access to the drawings 13 that are enclosed within the container 10.

The container 10 is provided with flanges 24 and 26 (FIGS. 1 and 5) which facilitate the attachment of the container 10 to a suitable location, such as the equipment 15 which is described within the drawings 13 that are located within the container 10. The lower portion of the container 10 is provided with a clear plastic pouch 28 within which may be inserted a paper card or the like on which suitable descriptive material may be provided to describe the contents of the container 10, such as for example the name and part numbers of the items that are drawn on the drawings 13.

Figure 4:
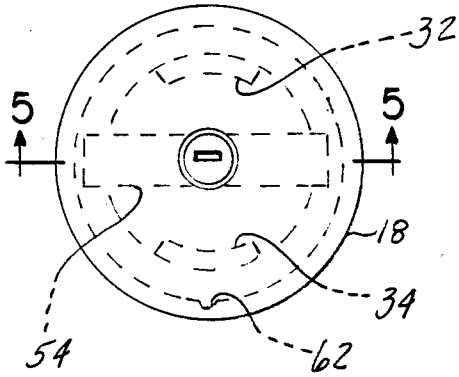
FIG. 4 is a top plan view of the cover illustrated in FIG. 3.
Figure 5:
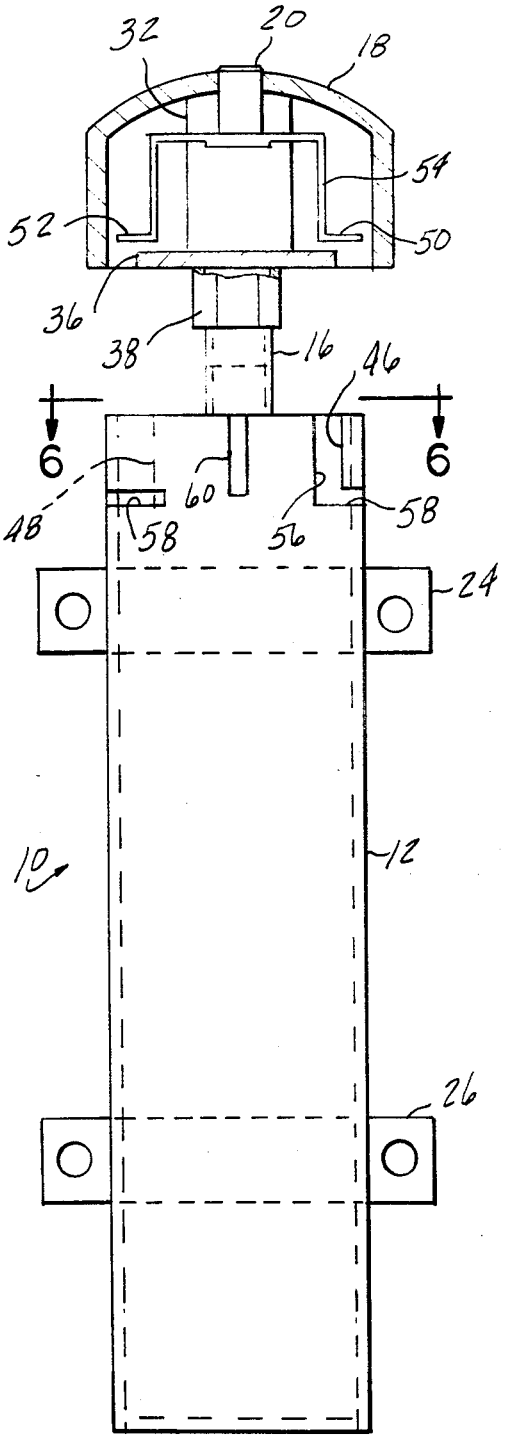
FIG. 5 is a partially sectioned view of the cover as seen from line 5—5 of FIG. 4 and with the cover being partially extended from the container.
Figure 3:
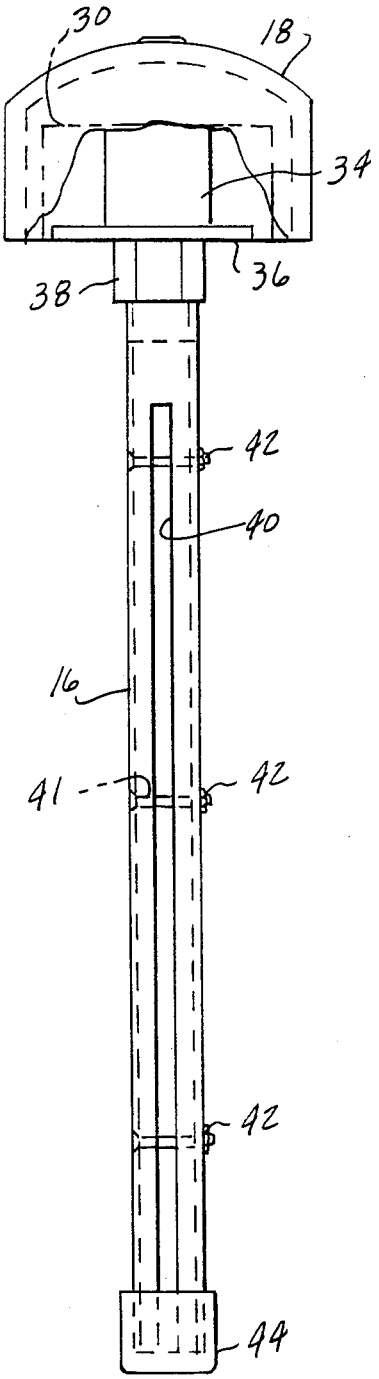
FIG. 3 is an enlarged plan view of the cover and mounting post illustrated in FIG. 2 with the drawings removed for clarity.

Referring now to FIGS. 3, 4 and 5 for a more detailed description of the cover 18 and the post 16 carried thereby, it can be seen that the cover 18 is cup-shaped having an inner diameter which is of sufficient size to permit the reception of the top portion of the container 12 therein, as shown by the phantom lines 30.

The cover 18 is similar to the tubular member 12 in that it likewise may be fabricated from a suitable plastic material, such as a PVC plastic. The interior surface of the cover 18 is provided with a pair of downwardly depending support flanges 32 and 34 which are secured at their upper ends to the cover 18 by any suitable means, such as an adhesive, and at their lower ends to a circular member 36, the lower section of which has a plug 38 secured thereto. The plug 38 is hollowed to snugly receive the upper end of the post 16 which is secured therein by any suitable means, such as an adhesive.

Figure 6:
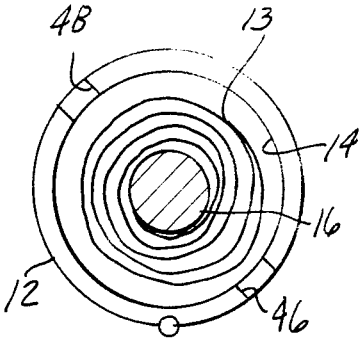
FIG. 6 is a cross-sectional view taken along line 6—6 of FIG. 5.

As can best be seen in FIG. 3, the post 16 which is hollow is provided with a longitudinal slot 40 that extends from its lower end to a point just below the plug 38. As can also be seen in FIG. 3, the post 16 is provided with a plurality of longitudinally spaced through bores 41 which accommodate fastening members 42. The lower end of the post 16 is enclosed by a cap 44. It can thus be seen that when it is desired to attach a plurality of drawings 13 to the post 16, the cap 44 is removed as is each of the fasteners 42 from the post 16. The prints 13 have their shorter edge apertured at spaced locations corresponding to the post bores 41 and are aligned therewith to permit the insertion and passage therethrough of the fasteners 42 which are then tightened in the conventional matter, sandwiching the drawings 13 between the legs of the post 16 defined by the slot 40. The cap 44 is then replaced and the drawings 13 are securely attached to the post 16 whereupon they may be rolled about the post 16 and ready for insertion within the container 10, as shown in FIG. 6.

Referring now to FIGS. 4 and 5, it can be seen that the upper portion of the tubular member 12 has a pair of L-shaped slots 46 and 48 which are respectively adapted to receive the horizontally disposed feet 50 and 52 of U-shaped locking member 54. The L-shaped slots 46, 48 have a vertical section 56 which has a width corresponding to the width of the locking member 54 and a horizontal section 58 which has a width slightly greater than the width of the feet 50, 52. The section 58 extends approximately 125° around each side of the tubular member 12. The slots 46, 48 extend completely through the thickness of the tubular member 12 and are open at the upper end 14, as shown in FIG. 6.

The outer surface of the tubular member 12 is provided with a guide rod 60 which is sized to be slidably received within a correspondingly shaped recess 62 formed on the interior surface of the cover 18 (see FIG. 4) so as to always align the cover 18 with the tubular member 12 such that the slots 46, 48 are properly aligned with the member 54 when the same is rotated by the key 22 to the open position. In this manner the cover 18 may be lowered onto the top of the tubular member 12 with the locking member feet 50, 52 being respectively received by the vertical sections 56 of the slots 46, 48. Once the cover 18 is fully positioned on the tubular member 12, the feet 50, 52 are respectively aligned with the horizontal slots 58 of the associated apertures 46, 48. Rotation of the lock 24 by the key 22 will rotate the locking member 54 in a counterclockwise direction as viewed in FIG. 4, permitting the feet 50 and 52 to be engaged within the horizontal slots 58, locking the cover 18 to the tubular member 12 and thereby securing the drawings 13 therein.

It can be seen that the present invention accomplishes several important objectives. The first is the provision of the container in close proximity to the equipment to which the drawings within the container relate. Second, the provision of the locking mechanism ensures access to the drawings 13 to only those limited authorized personnel who will have a need to use the prints. Third, securing the drawings 13 to the post 16 of the container 10 ensures that the drawings 13 will not be accidently misplaced or lost, as they are all grouped together and to an item which has a peculiar and specific use, and those personnel in the area will recognize that the cover and the drawings 13 associated therewith must eventually be returned to the container 10, thus minimizing the possibility that the drawings 13 will not be found in close proximity to the equipment 15 described in the drawings 13.

Fourth, it can also be seen that the various covers 18 and their associated tubular members 12 may be color coded so as to not only match each other, but to match the particular equipment upon which they are attached.

While only one form of the present invention has been disclosed, it should be understood by those skilled in the art of storage containers that other forms of the present invention may be had, all coming within the spirit of the invention and scope of the appended claims.

What is claimed is as follows:

1. A container for storing one or more sheets of drawings depicting the construction and/or operation of piece of equipment, the container comprising:

an elongated tubular member having first and second ends with an opening formed at the first end;

a cover receivable on the first end of the tubular member to enclose the first end of the tubular member;

locking means mounted on the cover and rotatable between a first unlocked position enabling removal of the cover from the tubular member and a second locked position locking the cover on the first end of the tubular member;

key means removably insertable into the locking means for rotating the locking means between the first and second position;

a post attached to and depending from the cover and receivable within the tubular member when the cover is mounted on the first end of tubular member;

means formed on the post, for securing an edge of the drawing thereto such that the drawing may be rolled about the post and inserted into the tubular member with the post;

means for mounting the tubular member on the predetermined equipment with which the drawings is associated;

a plurality of L-shaped slots formed in the tubular member adjacent to the first end of the tubular member; and a plurality of radially extending feet attached to the locking means and rotatable therewith, the feet being selectively engagable in the slots of the tubular member to selectively lock the cover to the tubular member when the locking means is rotated to the first locked position while the cap and post remain in a stationary position within the tubular member and to enable release of the cover from the tubular member upon rotation of the locking means to the second unlocked position.

2. The container defined in claim 1 wherein the mounting means comprises flanges attached to the outside surface of the tubular member; and means for fastening the flanges to the piece of equipment.

3. The container defined in claim 1 wherein the post has one end fixedly secured to the cover, the other end of the post having a slot extending therefrom toward the cover and laterally spaced fastening means positioned along the length of the slot extending through the post and adapted to extend through the drawing which is disposed within the slot for securing the drawing to the post.

4. The container defined in claim 1 wherein the cover and the tubular member are color coded.

5. A container for storing one or more sheets of drawings depicting the construction and/or operation of piece of equipment, the container comprising:

an elongated tubular member having first and second ends with an opening formed at the first end;

a cover receivable on the first end of the tubular member to enclose the first end of the tubular member;

the cover and the tubular member being identically color coded;

locking means mounted on the cover and rotatable between a first unlocked position enabling removal of the cover from the tubular member and a second locked position locking the cover on the first end of the tubular member;

key means removably insertable into the locking means for rotating the locking means between the first and second position;

a post attached to and depending from the cover the post being receivable within the tubular member when the cover is mounted on the first end of tubular member;

means formed on the post, for securing an edge of the drawing thereto such that the drawing may be rolled about the post and inserted into the tubular member along with the post;

a plurality of flanges attached to the outside surface of the tubular member;

a plurality of fastening means for fastening the flanges to the piece of equipment;

the post has one end fixedly secured to the cover, the other end of the post having a slot extending therefrom toward the cover and laterally spaced fastening means positioned along the length of the slot extending through the post and adapted to extend through the drawing which is disposed within the slot for securing the drawing to the post;

a plurality of L-shaped slots formed in the tubular member adjacent to the first end of the tubular member; and a plurality of radially extending feet attached to the locking means and rotatable therewith, the feet being selectively engagable in the slots of the tubular member to selectively lock the cover to the tubular member when the locking means is rotated to the first locked position while the cap and post remain in a stationary position within the tubular member and to enable release of the cover from the tubular member upon rotation of the locking means to the second unlocked position.

* * * * *